US005172086A

United States Patent [19]

Fujihisa et al.

[11] Patent Number: 5,172,086

[45] Date of Patent: Dec. 15, 1992

[54] REMOTELY CONTROLLED RELAY

[75] Inventors: Hiroaki Fujihisa; Manabu Sogabe, both of Hiroshima, Japan

[73] Assignee: Mitsubishi Denki Kabushiki Kaisha, Tokyo, Japan

[21] Appl. No.: 704,086

[22] Filed: May 22, 1991

[30] Foreign Application Priority Data

May 23, 1990 [JP] Japan ..... 2-133026

[51] Int. Cl.[5] ..... H01H 75/00

[52] U.S. Cl. ..... 335/14; 335/20

[58] Field of Search ..... 335/6, 16, 14, 20

[56] References Cited

U.S. PATENT DOCUMENTS

Re. 32,882 3/1989 Yokoyama et al. .

4,623,859 11/1986 Erickson et al. ..... 335/14

4,897,625 1/1990 Yokoyama et al. ..... 335/14

5,053,735 10/1991 Ohishi et al. .

*Primary Examiner*—Lincoln Donovan

*Attorney, Agent, or Firm*—Burns, Doane, Swecker & Mathis

[57] ABSTRACT

A remotely controlled relay having two micro-switches driven to open and close by the plunger of a bistable polar electromagnet device. A current is supplied to the coil of the electromagnet device from an external power source to magnetize the plunger so that the plunger is moved through a stroke between a first position and a second position. When the plunger moves from the first position to the second position, a first micro-switch is closed to energize the coil in a first direction until the plunger passes through the middle of the stroke. When the plunger moves from the second position to the first position, a second micro-switch is closed to energize the coil in a second direction until the plunger passes through the middle of the stroke.

3 Claims, 12 Drawing Sheets

REMOTELY CONTROLLED RELAY

BACKGROUND OF THE INVENTION

The present invention relates to a remotely-controlled relay. FIG. 11 shows a remotely-controlled relay described in the same inventor's copending U.S. patent application Ser. No. 704,037 based on Japanese Patent Application No. 2-133027 which has the same filing date in Japan as that of the present invention. FIG. 14 shows the electrical circuit of the remotely controlled relay shown in FIG. 11. FIG. 12 shows the relevant portion of the remotely controlled relay when a main circuit is open. When an operating switch is switched to the position J shown in FIG. 14, an operating current flows through a diode D2 and a coil 6 to drive a plunger 5 in the direction of the arrow A in FIG. 12. At this time, an operating lever 28 rotates clockwise. When the plunger 5 reaches the middle of its stroke, the operating lever 28 drives at its abutment 28*c* the actuator 26*a* of a micro-switch 26 so that the micro-switch 26 is switched to have a movable contact thereof in contact with 26*d*. The plunger 5 further advances upwards with the aid of inertia until it is securely attracted by the upper end of a yoke 8, causing the contacts 11 and 21 of the main circuit to close.

FIG. 13 shows a relevant portion of a remotely controlled relay when a main circuit is closed. When an operating switch is switched to the position K in FIG. 14, the operating current flows through a diode D1 into the coil 6 to drive the plunger 5 in the direction of the arrow E in FIG. 13. At this time, the operating lever 28 rotates counterclockwise. When the plunger 5 reaches the middle of its stroke, the operating lever 28 drives at the abutment 28*c* the actuator 26*a* so that the micro-switch 26 is switched to have a movable contact thereof in contact with 26*c*. The plunger 5 further advances upward with the aid of inertia until it is securely attracted by the bottom of the yoke 8, causing the contacts 11 and 21 of the main circuit to open. In general, this type of bistable polar electromagnet device has a micro-switch that is switched at the middle of the plunger stroke. Thus, the attracting force of magnetized yoke 8 that attracts the plunger becomes increasingly stronger as the plunger becomes closer to the upper end or bottom of the yoke 8. This requires precise adjustment of the position of the micro-switch relative to the position of the plunger in its stroke where the micro-switch is switched from one contact to another. Thus, the manufacture of the relay is not easy. For sure operation of the micro-switch, a high current is run through the coil 6 so that the plunger 5 is driven by a large magnetic force to pass through the middle of the stroke with a large inertia.

SUMMARY OF THE INVENTION

An object of the invention is to provide a remotely-controlled relay that requires no critical, precise adjustment of the position of micro-switch relative to that of the plunger in its stroke such that the micro-switch is switched from one contact to another to change the direction of driving current through the relay coil.

Another object of the invention is to provide a remotely controlled relay that requires only a small current for magnetizing the relay coil to drive the plunger.

A remotely controlled relay according to the present invention has two micro-switches driven by the plunger of a bistable polar electromagnet device. A current is supplied to the coil of the electromagnet device from an external power source to magnetize the plunger so that the plunger is moved through a stroke between a first position and a second position. When the plunger moves from the first position to the second position, a first micro-switch is closed to energize the coil in a first direction until the plunger passes through the middle of the stroke. When the plunger moves from the second position to the first position, a second micro-switch is closed to energize the coil in a second direction until the plunger passes through the middle of the stroke.

BRIEF DESCRIPTION OF THE DRAWINGS

Features and other objects of the invention will be more apparent from the description of the preferred embodiments with reference to the accompanying drawings in which.

DETAILED DESCRIPTION OF THE

Embodiment

Figure 1:
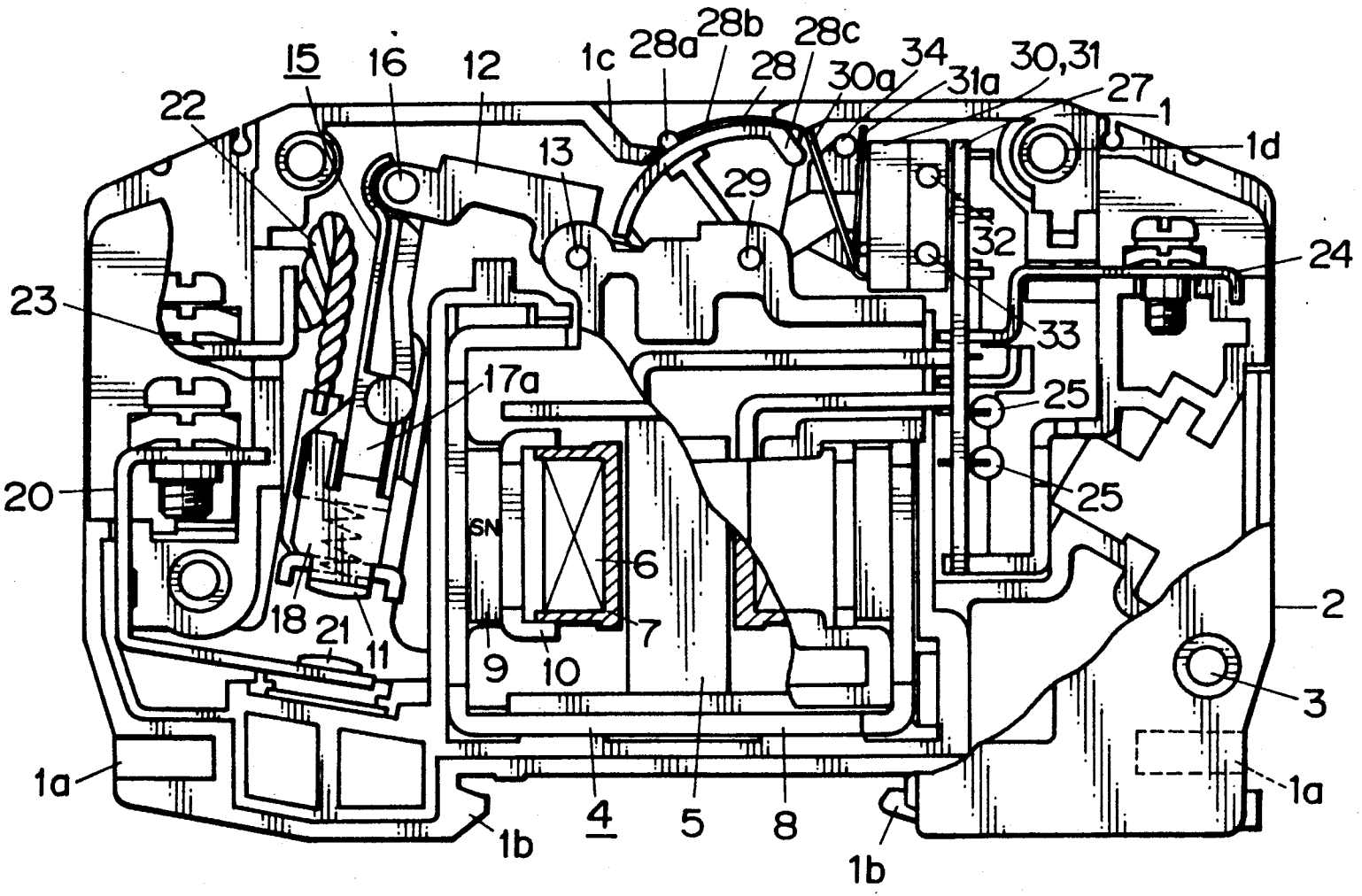
FIG. 1 is a side view of a remotely controlled relay according to the invention when the main circuit is open.
Figure 2:
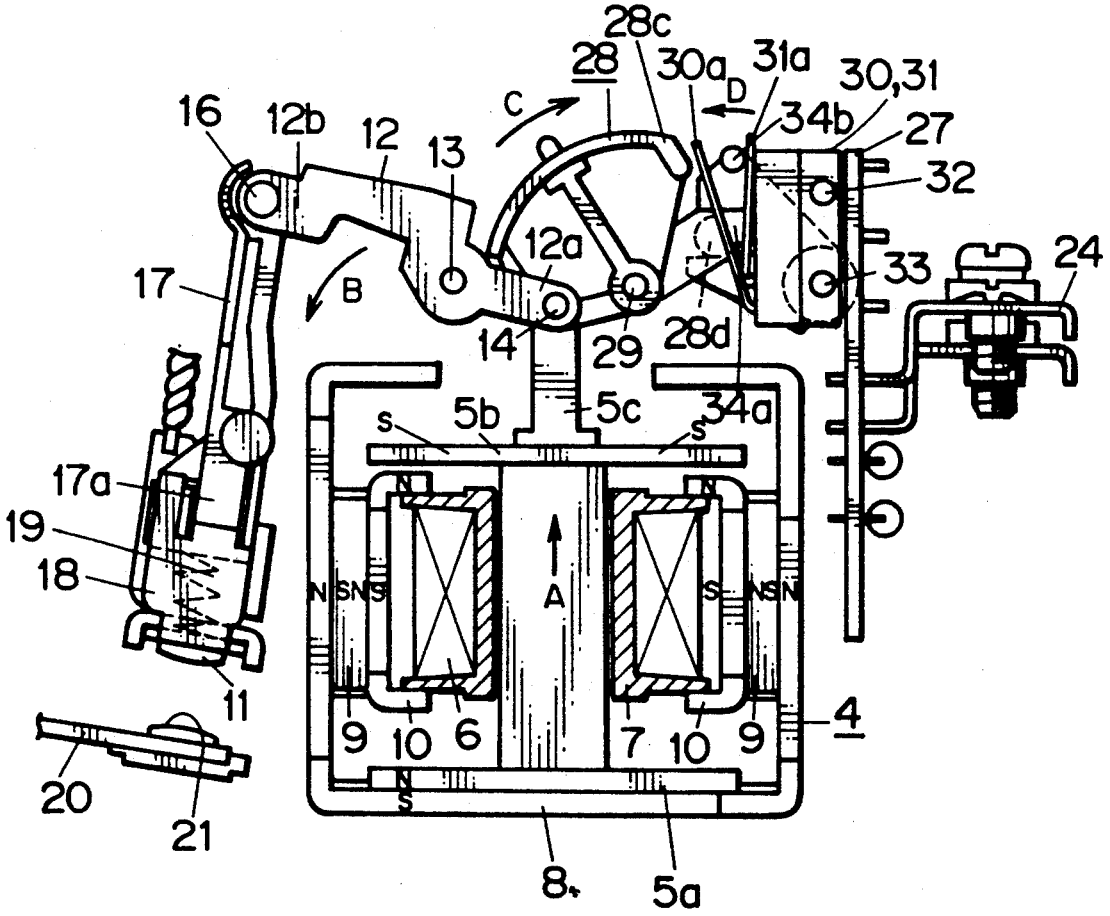
FIG. 2 is a side view showing the relevant portion of FIG. 1.
Figure 3:
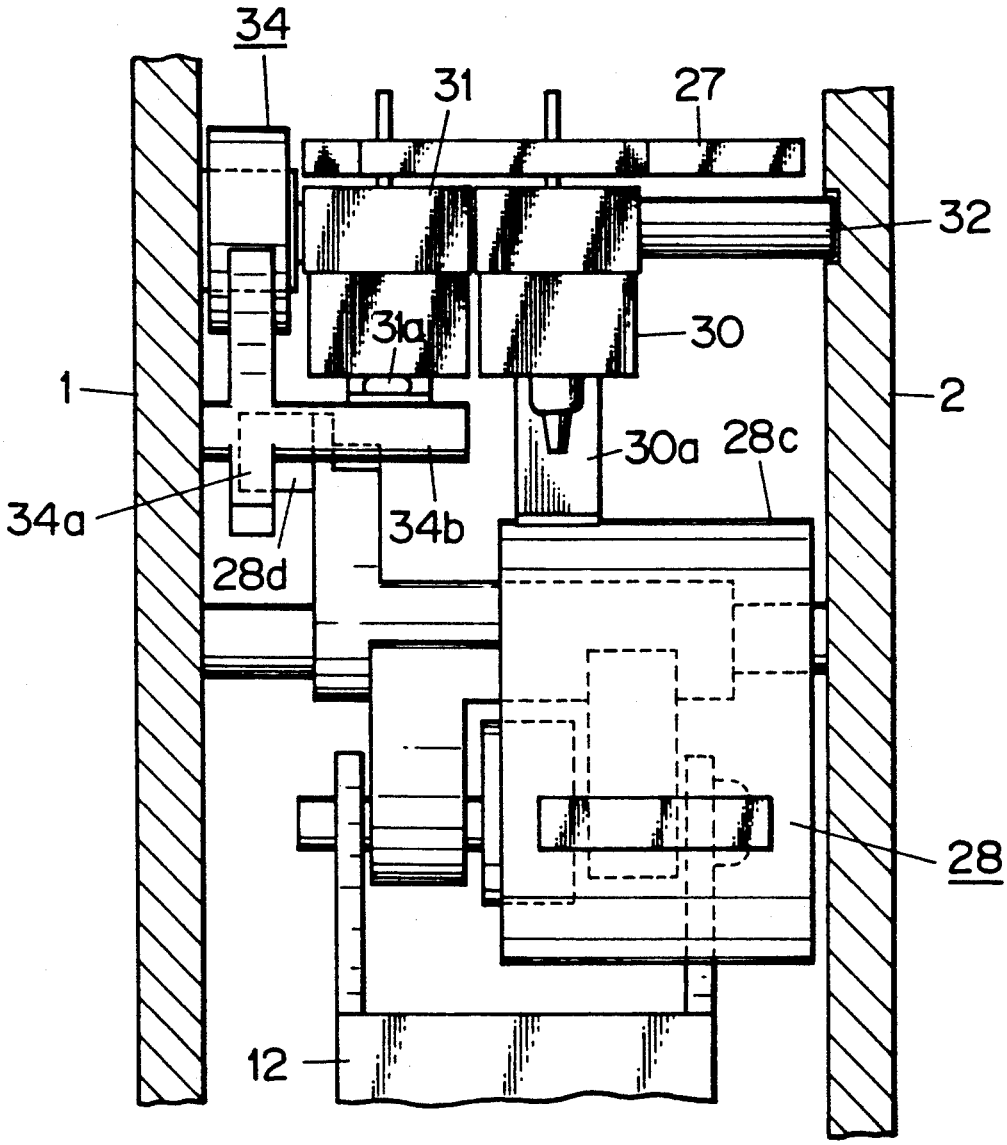
FIG. 3 is a top view of FIG. 2.
Figure 4:
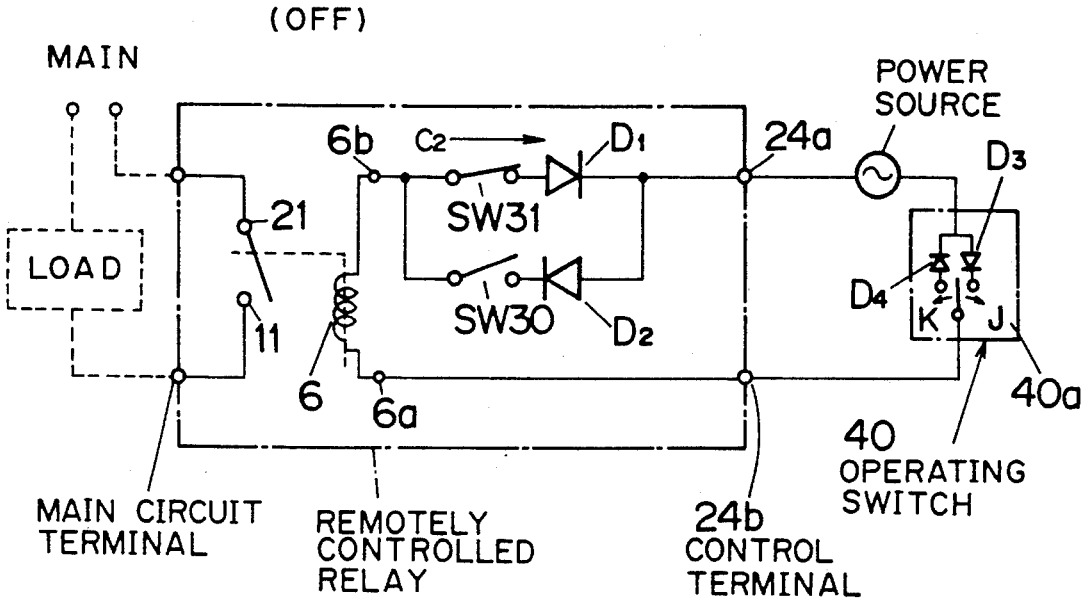
FIG. 4 shows an electrical circuit of the remotely controlled relay in FIG. 1.

An embodiment of the present invention will now be described in detail with reference to the drawings. FIG. 1 is a general side view of a remotely-controlled relay according to the invention. FIG. 2 is a side view of a relevant portion of FIG. 1. FIG. 3 is a top view of FIG. 2 and FIG. 4 is a side view of a relevant portion of FIG. 1.

A housing consists of a base 1 and a cover 2 which are riveted together at four locations by rivets 3. The housing has grooves 1*a* into which mounting angles are inserted, projections by which the relay is mounted on DIN rails, and an aperture 1*c* at the top of the housing.

An electromagnet device 4 is of a bistable polar type having two stable positions where a plunger 5 is securely attracted by a magnet, and is provided in the middle of the base 1. As shown in FIGS. 1 and 2, a coil 6 is wound about a bobbin 7, shown hatched, through which the plunger 5 slidably extends. The plunger 5 acts as an armature having a top end 5*b* and a bottom end 5*a*, attracted by a yoke 8 magnetized by a permanent magnet 9. The bobbin 7 and the plunger 5 are housed in a first yoke 8, and the plunger 5 extends at a distal end thereof outwardly of the yoke 8 through an aperture 8*a*. On the inner wall of the first yoke 8 is provided a pair of permanent magnets 9. A second yoke 10 having a generally U-shaped cross section is mounted between the permanent magnet 9 and bobbin 7 such that the yoke 10 abuts the magnet 9 as well as holds the bobbin 7. A link 12 is pivotally mounted on the base 1 by means of a pin 13, and is pivotally connected at one end 12*a* thereof through a pin 14 to the plunger tip end 5*c* and at the other end 12*b* to one end of a movable-contact assembly 15 through a pin 16. The movable-contact assembly 15 is provided with an insulator 17 having a groove 17*a* into which a movable piece 18 engages in sliding relation. The movable piece 18 has a contact 11 which is electrically connected with a terminal 23 of the main circuit by means of a shunt 22. The contact 11 is provided with a compression spring 19 that urges the contact 11 against a fixed contact 21 on a terminal 20 of the main circuit. The movable-contact assembly 15 and the contacts 11 and 21 form a main-circuit-opening and closing assembly. A pin 17*b* mounted to the insulator 17 loosely engages and is guided by a groove(not shown) in the base 1 and a groove(not shown) in the cover 2 so that the movable-contact assembly 15 is operatively driven by the plunger 5 to close and open the contacts 11 and 14.

The operating lever 28 is pivotally mounted to the base 1 by means of a pin 29 and is pivotally connected to the tip end 5*c* by means of a pin 14. The operating lever 28 pivots about the pin 29 when the plunger moves up and down. The operating lever 28 has a handle 28*a* facing the aperture 1*c* for manually operating the lever 28. On both sides of the handle 28*a* is provided a display 28*c* that indicates ON and OFF states of the contacts 11 and 14.

Micro-switches 30 and 31 each have two holes therein through which pins 32 and 33 extends. The pins 32 and 33 are supported by the base 1 and cover 2. Thus, the two micro-switches are properly aligned in their relative positions by the aid of the pins 32 and 33. To the pin 33 is pivotally connected an actuating lever 34 driven into pivotal motion by a projection 28*d* of the operating lever 28, which engages the bifurcation 34*a* of the actuating lever 34. When the operating lever 28 rotates about the pin 29, a projection 34*b* engages the actuator 31*a* of the micro-switch 31 to open and close the switch 31 while the abutment 28*c* engages the actuator 30*a* of the micro-switch 30.

FIG. 4 shows an electrical circuit of the remotely-controlled relay in FIG. 1. One end 6*a* of the coil 6 is connected to a control terminal 24*b* and the other 6*b* to the common terminals of the micro-switches 30 and 31. The contact of the micro-switch 30 is connected with the cathode of a diode D2, and the contact of the micro-switch SW31 to the anode of a diode D1. The cathode of D1 and the anode of D2 are connected together to control terminals 24*a*. Between the terminals 24*a* and 24*b* is connected an external series connection of a power source and an operating switch 40 that includes diodes D3 and D4 and a normally open single-pole-double-throw switch 40*a*.

OPERATION

OFF-to-ON Operation

Figure 5:
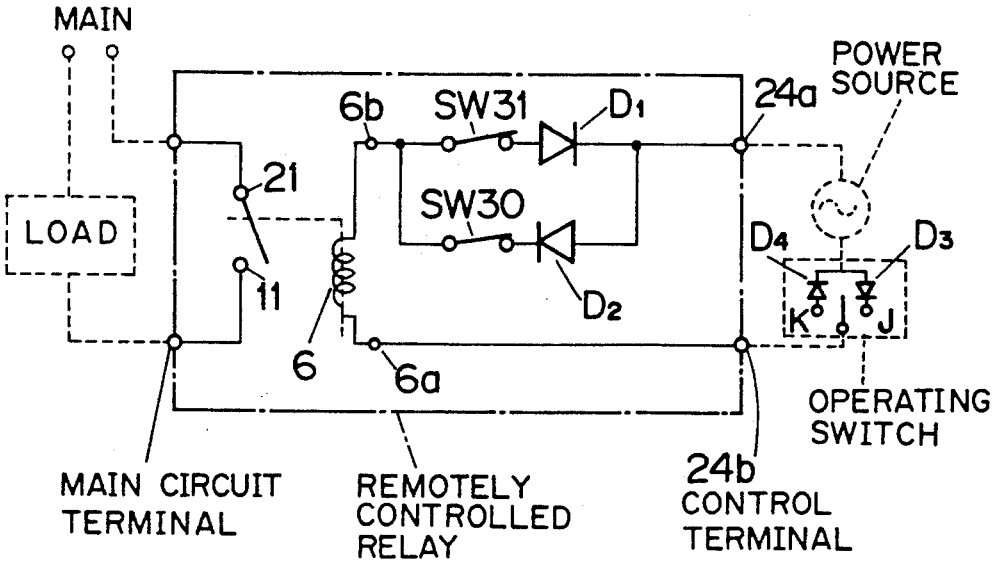
FIG. 5 is the electrical circuit of FIG. 6.
Figure 6:
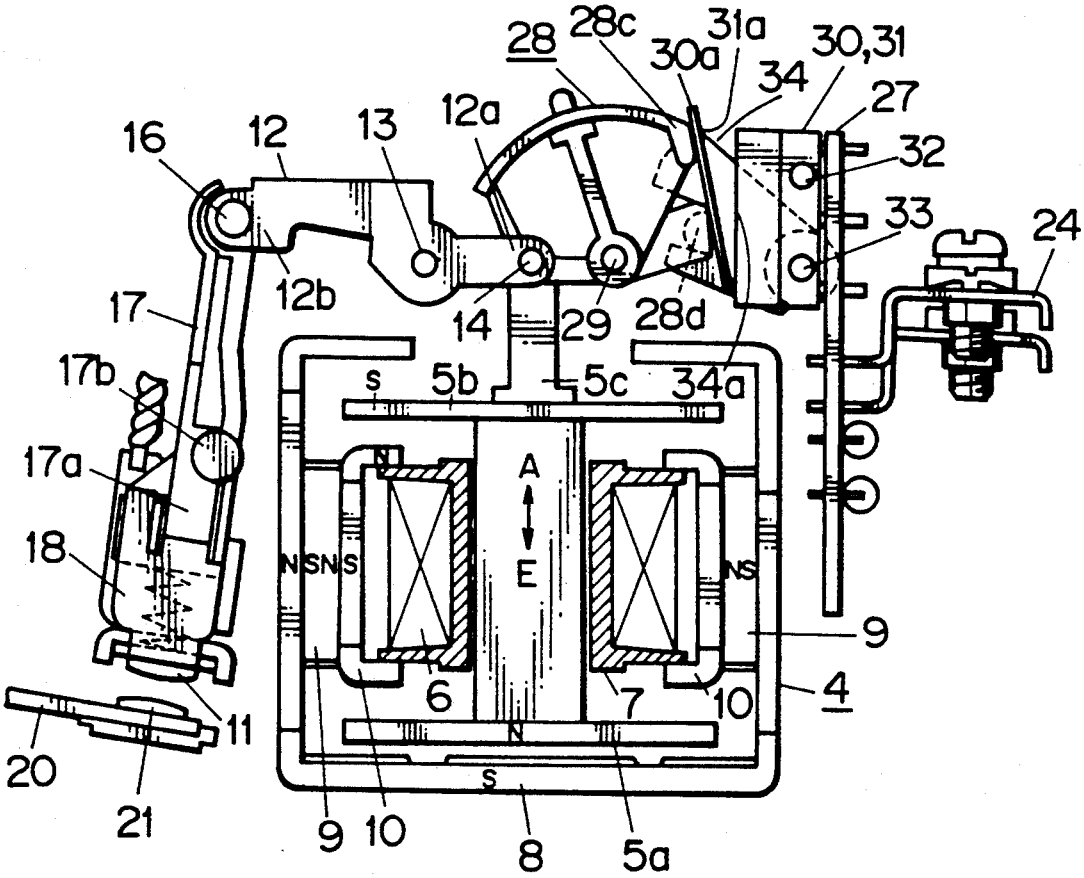
FIG. 6 shows a plunger at the middle of its stroke.
Figure 10:
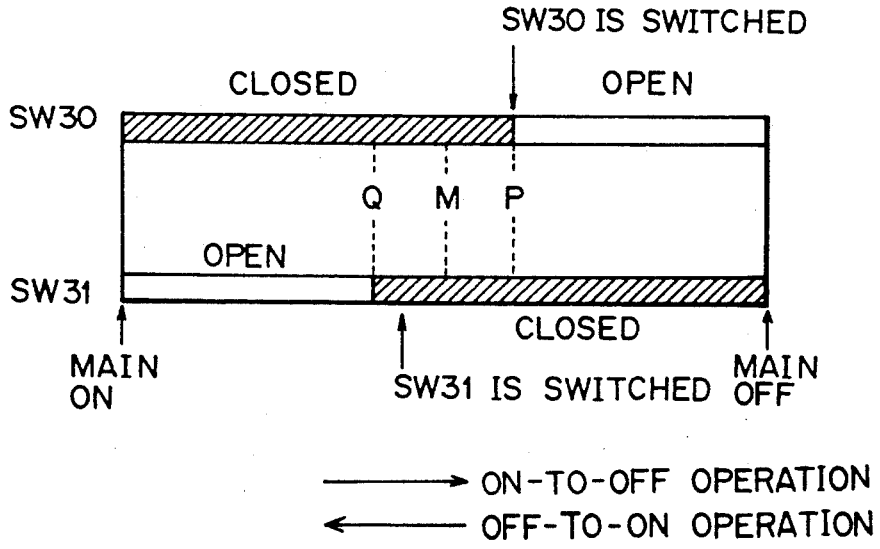
FIG. 10 illustrates the relationship between the movement of plunger and the timing at which the micro-switch is switched.
Figure 11:
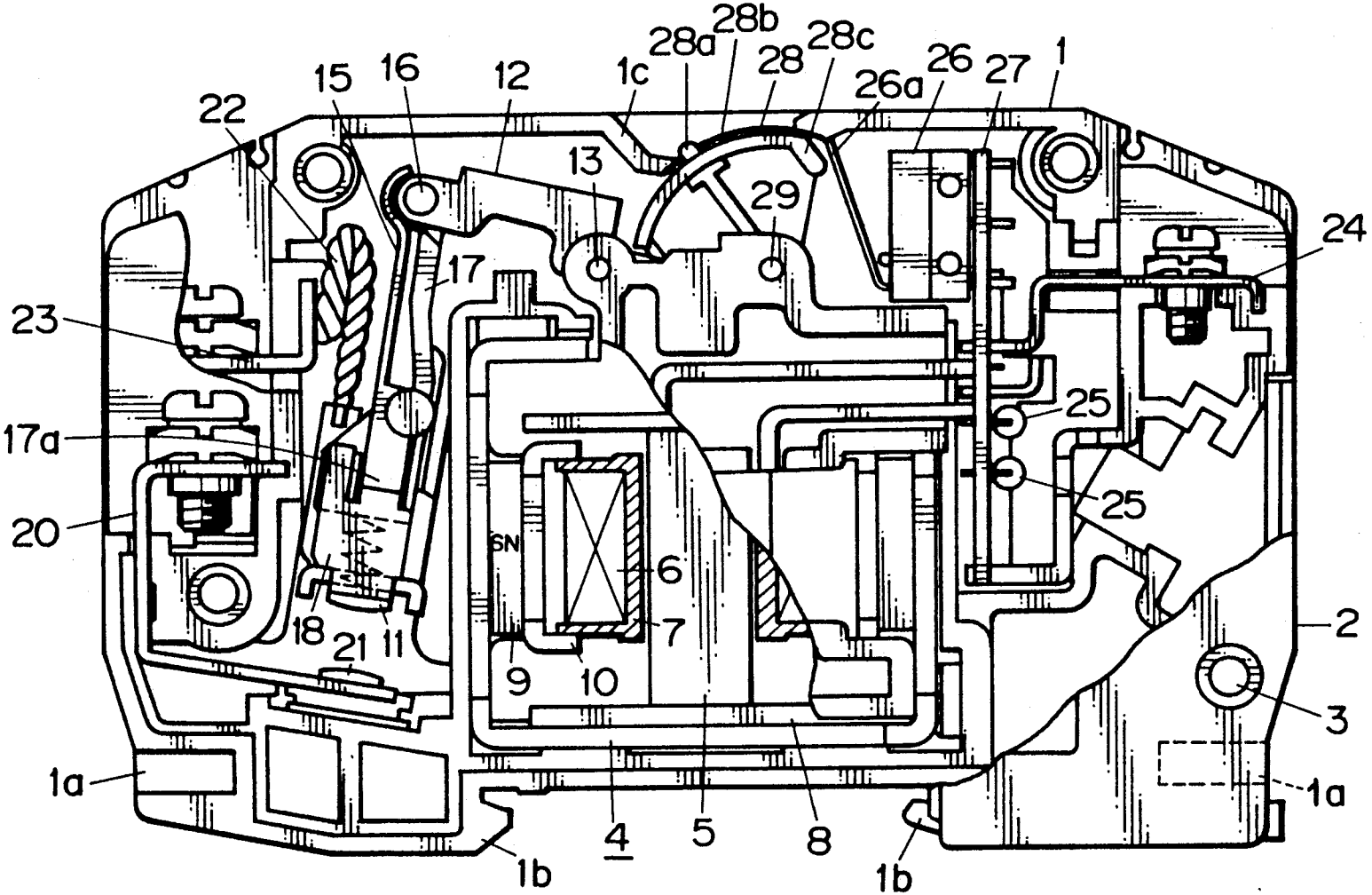
FIG. 11 shows a remotely controlled relay described in Japanese Patent Application No. 2-133027.
Figure 12:
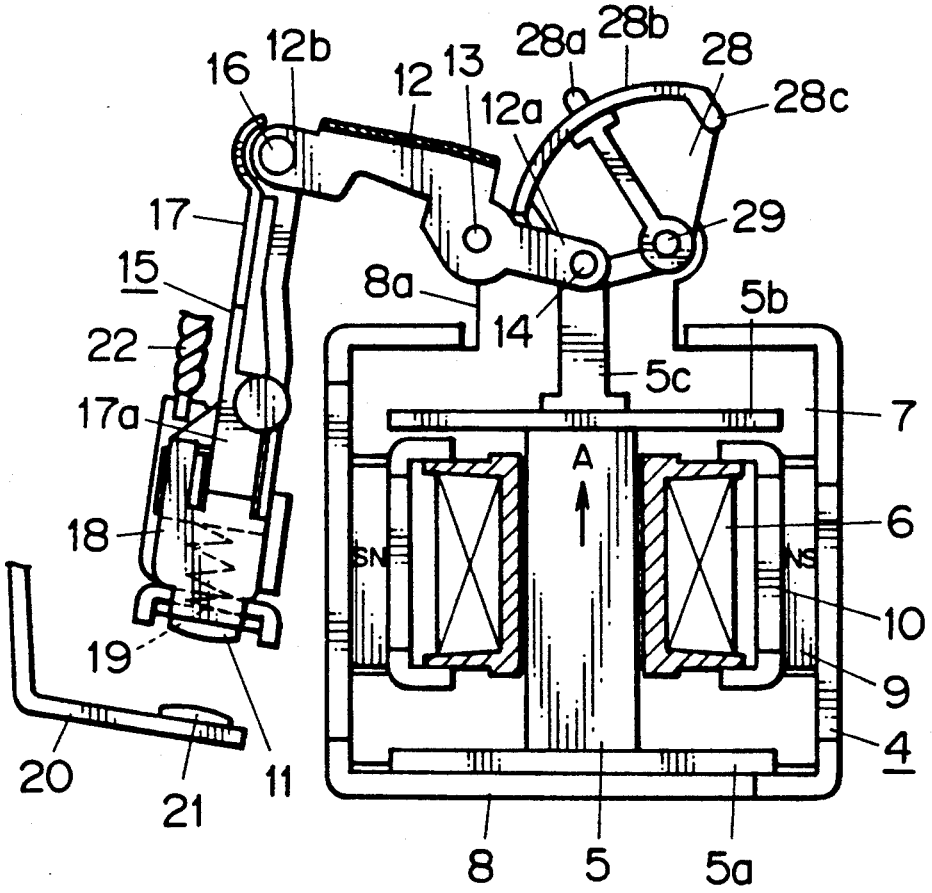
FIG. 12 shows the relevant portion of the remotely controlled relay in FIG. 11.
Figure 13:
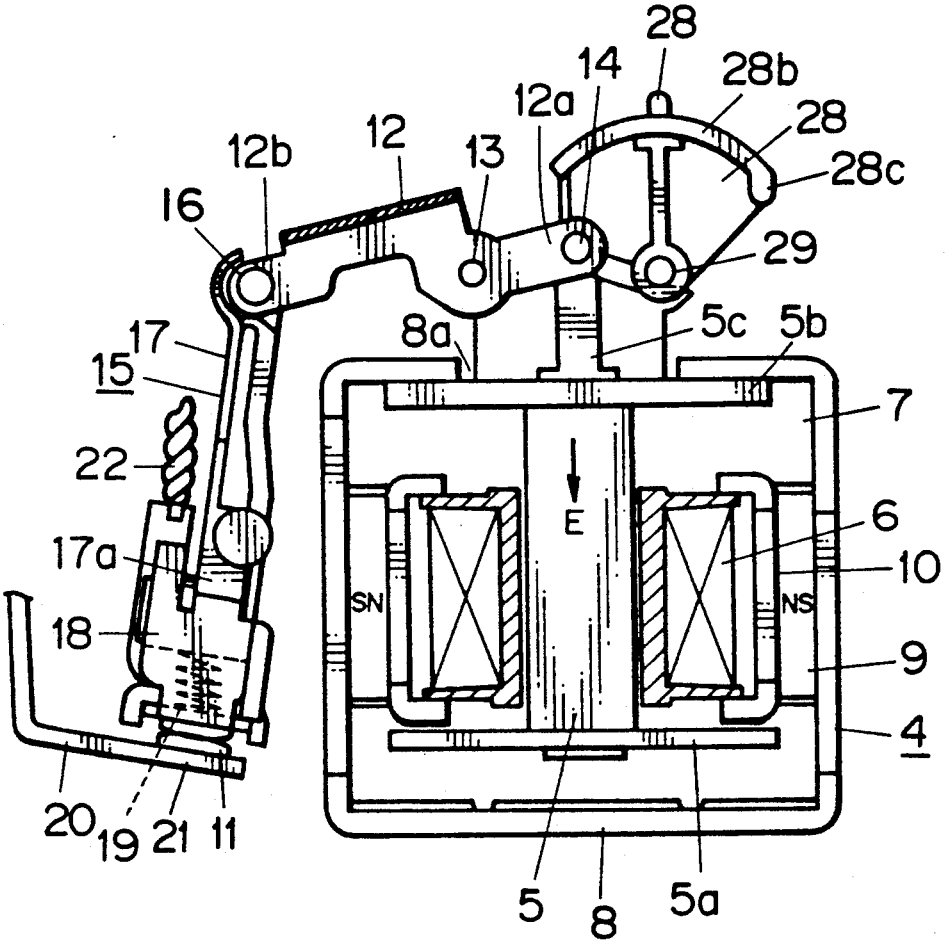
FIG. 13 shows the relevant portion of FIG. 11 when the main circuit is closed.
Figure 14:
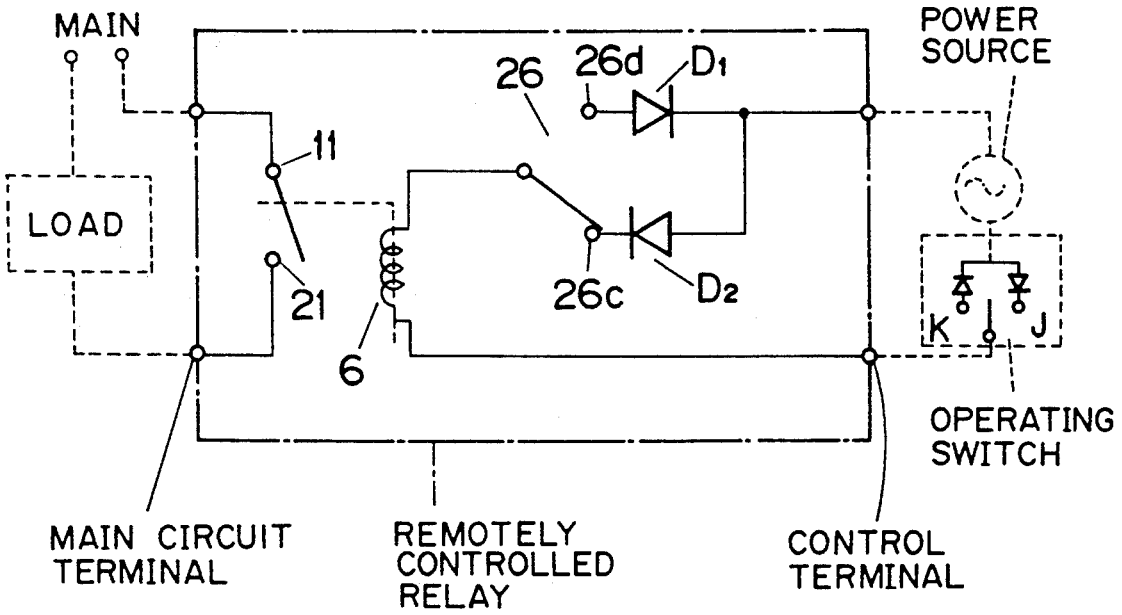
FIG. 14 shows an electrical circuit of the remotely controlled relay in FIG. 11.

FIG. 10 illustrates the relationship between the movement plunger and the timing at which the micro-switch is switched. As shown in FIG. 2, the bottom end 5*a* is at the bottom of the yoke 8, securely attracted by the yoke 8. When the switch 40*a* is switched to the position J, an ON-operating current flows in the direction of the arrow C2 through the loop of D3—contact J—coil 6—SW 31—D1—power source. The coil 6 magnetizes the plunger 5 in a direction opposite to the magnetic poles shown in FIG. 2, so that the plunger 5 repels the S pole of the bottom of yoke 8 and is driven in the direction of A in FIG. 2 to move to a point P in FIG. 10, causing the link 12 to rotate in the direction of B and operating lever 28 in the direction of C. At this time, the operating lever 28 engages at 28*c* the actuator 30 to drive the micro-switch 30 into the closed position while also causing the actuating lever 34 to rotate in the direction of D. Both the micro-switches SW30 and SW31 are closed during the time when the plunger travels from point P to point Q in FIG. 10. FIG. 6 shows the positional relationship between the relevant mechanical parts and FIG. 5 shows the electrical circuit of FIG. 6. It should be noted that the micro-switches 30 and 31 are both closed. In FIG. 6, the plunger 5 is advancing in the direction A. Although the micro-switches 30 and 31 are both closed while the plunger 5 is between points P and Q, no current flows through the micro-switch 30. The operating current continues to flow in the direction of C2 through the micro-switch 31 to drive the plunger 5 in the direction of A. Thus, the plunger 5 is driven until it reaches point Q past the middle point M of the plunger stroke. When the plunger 5 arrives at point Q, the actuating lever 34 acts on the actuator 31*a* to open the micro-switch 31. At this time, the operating-current path changes from the loop of D3—contact J—coil 6—SW31—D1—power source to the loop of D3—contact J—coil 6—SW30—D2—power source, so that even if the operator continues to depress the switch 40*a* to side J, no current flows in the coil 6. Thus, the coil 6 no longer produces a force to drive the plunger 5. The plunger 5 is now sufficiently close to the upper end of yoke 8 to be attracted towards the upper end and stops at the position shown in FIG. 7 closing the contacts 11 and 14.

ON-to-OFF Operation

Figure 7:
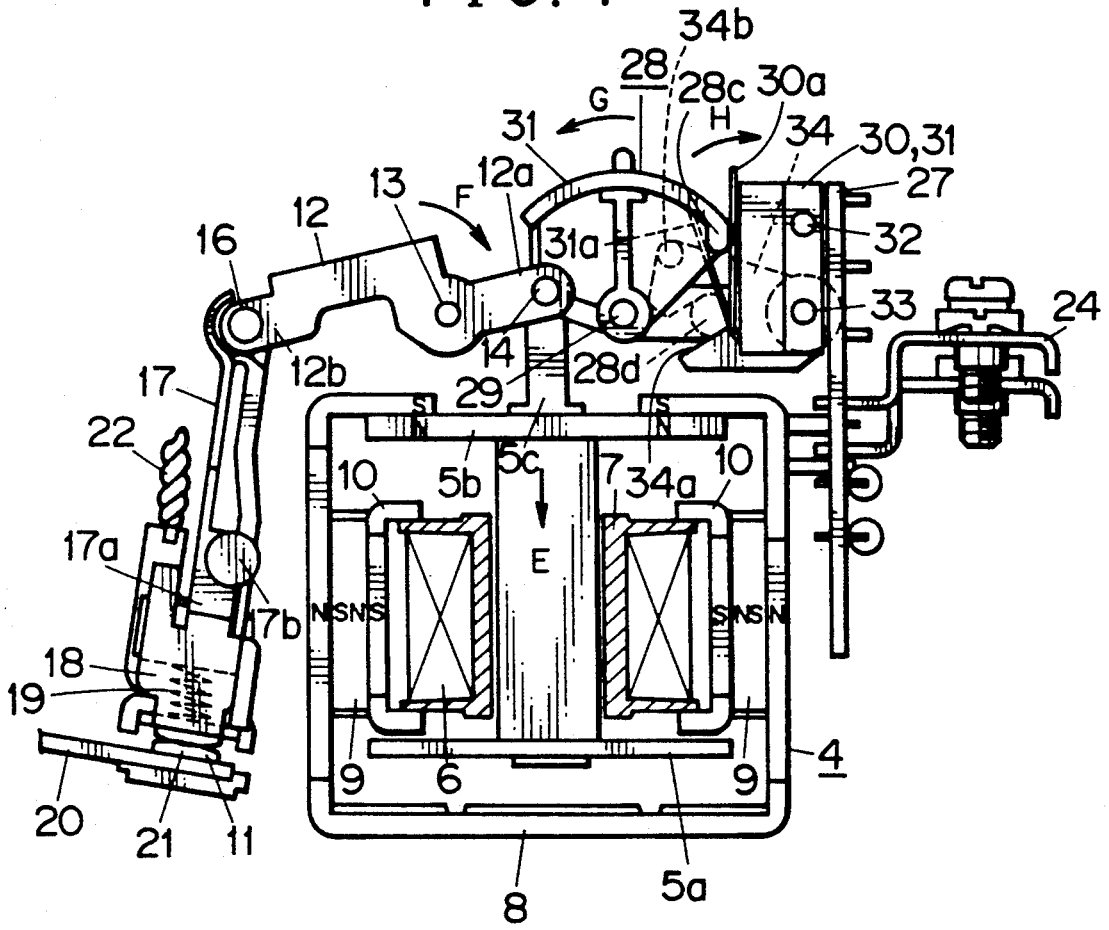
FIG. 7 is a side view of FIG. 1 showing the remotely controlled relay according to the invention when the main circuit is closed.
Figure 8:
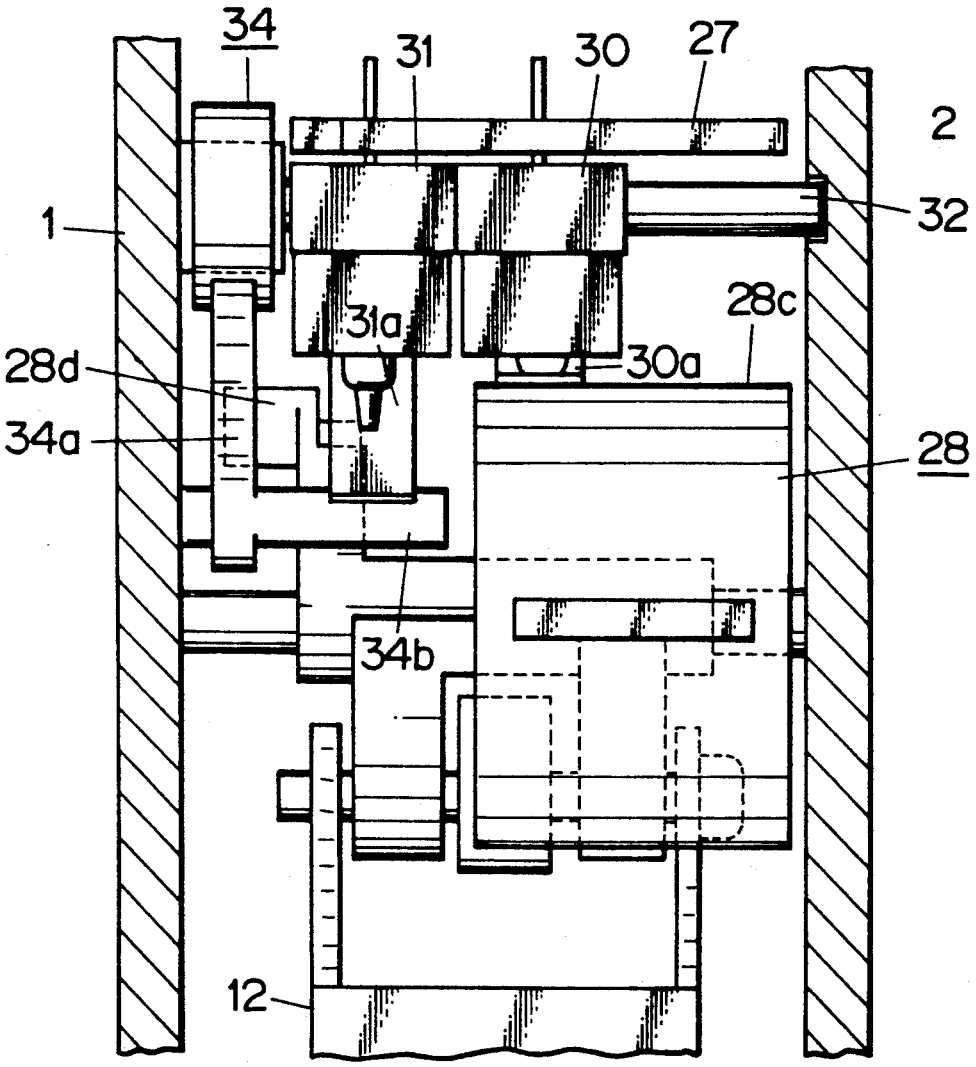
FIG. 8 is a top view of FIG. 7.
Figure 9:
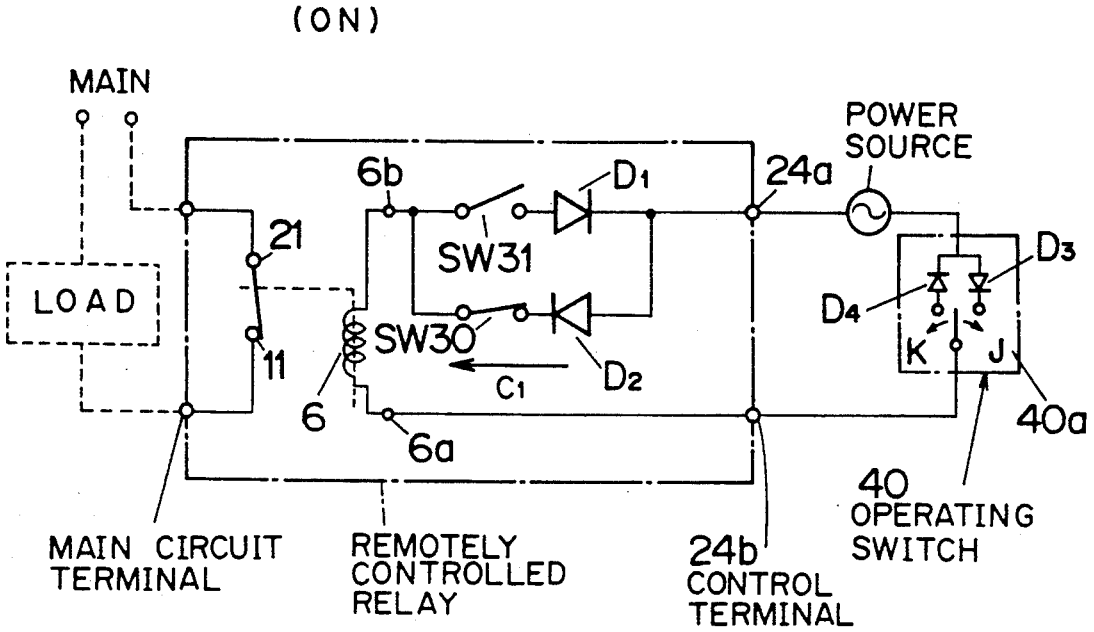
FIG. 9 shows the electrical circuit of the remotely controlled relay according to the invention when the main circuit is closed.

FIG. 7 is a side view showing a remotely-controlled relay when the main circuit is closed. FIG. 8 is a top view of FIG. 7. As shown in FIG. 7, the top end 5*b* is at the upper end of the yoke 8, securely attracted by the yoke 8. In FIG. 9, when the switch 40*a* is switched to the position K, an OFF-operating current flows in the direction of the arrow C1 through the loop of D2—SW-30—coil 6—contact K—D4—power source. The coil 6 magnetizes the plunger 5 to polarities opposite to those shown in FIG. 2, so that the plunger 5 repels the S pole of the upper end of yoke 8 and is driven in the direction of E to move to a point Q in FIG. 10, causing the link 12 to rotate in a direction of F and operating lever 28 in the direction of G. At this time, the operating lever 28 causes the actuating lever 34 to rotate in the direction of H. Both the micro-switches 30 and 31 are closed during the time when the plunger 5 travels from point P to point Q in FIG. 10. FIG. 6 shows the positional relationship between the relevant mechanical parts and FIG. 5 shows the electrical circuit of FIG. 6. It should be noted that the micro-switches 30 and 31 are both closed. In FIG. 6, the plunger is advancing in the direction of E. Although the micro-switches are both closed while the plunger 5 is between points P and Q, no current flows through the micro-switch 31. The operating current continues to flow in the direction of C1 through the micro-switch 30 to drive the plunger in the direction of E. Thus, the plunger 5 is driven until it reaches point P past the middle point M of the plunger stroke. When the plunger 5 arrives at point P, the actuating lever 34 acts on the actuator 30*a* to open the micro-switch 30. At this time, the operating-current path changes from the loop of D2—SW30—coil 6—contact K—D4—power source to a loop of D1—SW31 coil 6—contact K—D-4—power source, so that even if the operator continues to depress the switch 40*a* to the side K, no current flows in the coil 6. Thus, the coil 6 no longer produces a force to drive the plunger 5. Since the plunger is now sufficiently close to the bottom of yoke 8, the plunger is attracted towards the bottom and then stops at the position shown in FIG. 7 opening the contacts 11 and 14.

What is claimed is:

1. A remotely-controlled relay comprising:

a bistable polar electromagnet device for driving a main-circuit-opening and closing assembly, wherein said bistable polar electromagnet device includes;

a coil energized selectively in a first direction and in a second direction by a current supplied from an external circuit;

a plunger movable through a stroke between a first position and a second position, said plunger moving to said first position when said coil is energized in said first direction and moving to said second position when said coil is energized in said second direction;

a first switch circuit operatively driven by said plunger to close so as to energize said coil in said first direction until said plunger travels past an intermediate position of said stroke when said plunger moves from said first position to said second position; and a second switch circuit operatively driven by said plunger to close so as to energize said coil in said second direction till said plunger travels past an intermediate position of said stroke when said plunger moves from said second position to said first position.

2. A remotely-controlled relay according to claim 1, wherein said first switch circuit is a first series connection of a first micro-switch and a first diode that allows said current to flow in said coil to energize said coil in said first direction, said second switch circuit is a second series connection of a second micro-switch and a second diode that allows said current to flow in said coil to energize said coil in said second direction, said first switch circuit being in parallel with said second switch circuit such that said coil is energized by said first switch circuit in said first direction and by said second switch circuit in said second direction.

3. A remotely-controlled relay according to claim 2, wherein said relay further includes:

an operating lever driven by said plunger to drive said first micro-switch to open and close; and an actuating lever driven by said operating lever to drive said second micro-switch to open and close.

* * * * *